US008302969B2

(12) United States Patent
Srinivasa et al.

(10) Patent No.: US 8,302,969 B2
(45) Date of Patent: Nov. 6, 2012

(54) INVERSE CHESS

(76) Inventors: Prasanna Gorur Narayana Srinivasa, Karnataka (IN); Aditya Ramana Rachakonda, Tiruvallur-Tamilnadu (IN); Arvind Namasivayam, Tamilnadu (IN); Ashish Tulsian, Jhunjhunu-Rajasthan (IN); Bhagi Sri Karthik, Andra Pradesh (IN); Gurmeet Singh Gulati, Delhi (IN); Rohit Kumar Pandey, Bihar (IN); Samarth.S Prakash, Karnataka (IN); Siddhartha Reddy. K., Andra Pradesh (IN)

( * ) Notice: Subject to any disclaimer, the term of this patent is extended or adjusted under 35 U.S.C. 154(b) by 110 days.

(21) Appl. No.: 11/994,958

(22) PCT Filed: Jul. 7, 2006

(86) PCT No.: PCT/IN2006/000237

§ 371 (c)(1),
(2), (4) Date: Jan. 7, 2008

(87) PCT Pub. No.: WO2007/007349

PCT Pub. Date: Jan. 18, 2007

(65) Prior Publication Data

US 2008/0197569 A1 Aug. 21, 2008

(30) Foreign Application Priority Data

Jul. 7, 2005 (IN) ..... 901/CHE/2005

(51) Int. Cl.
*A63F 3/00* (2006.01)

(52) U.S. Cl. ..... 273/260; 273/255; 273/262

(58) Field of Classification Search ..... 273/255, 273/258, 260, 261, 262
See application file for complete search history.

(56) References Cited

U.S. PATENT DOCUMENTS

| | | | | | |
|---|---|---|---|---|---|
| 1,877,154 | A * | 9/1932 | Reed | 273/241 |
| 3,998,464 | A * | 12/1976 | Poturalski | 273/261 |
| 4,229,008 | A * | 10/1980 | Jameson | 273/261 |
| 5,351,965 | A * | 10/1994 | Telfer et al. | 273/260 |
| 6,382,626 | B1 * | 5/2002 | Ryff | 273/260 |
| 7,017,906 | B1 | 3/2006 | Benjamin | |
| 7,017,907 | B2 | 3/2006 | Labetti | |
| 2001/0044335 | A1 * | 11/2001 | Satake | 463/7 |
| 2002/0060427 | A1 * | 5/2002 | Hinami | 273/237 |
| 2005/0197186 | A1 * | 9/2005 | Ohta | 463/30 |

* cited by examiner

*Primary Examiner* — Vishu K. Mendiratta
(74) *Attorney, Agent, or Firm* — Birch, Stewart, Kolasch & Birch, LLP

(57) ABSTRACT

This invention describes a game of inverse chess, with a pre-identified start position, and end position and arbitered moves chosen amongst a set of possible moves, played between two opponents on a chess board. This differs from normal chess in that it is played backwards in time where the objective is to reconstruct the pre-identified start position, from the pre-identified end position. While the pieces used in the game are essentially the same as that of regular chess, the moves they make are reversed. Since the state-space of this game is much larger in the potential moves, an arbiter is used to validate possible moves that one player might choose to make. Using either a regular or modified chess board, the pieces on the board move backwards. Three such moves are described in the I-castle, spawn and I-check moves. A variant of the game is the two-knight game wherein two knights play each other and the piece reaching the pre-identified start position, win.

2 Claims, 16 Drawing Sheets

INVERSE CHESS

BACKGROUND

1. Field of the Invention

This invention relates to a game of inverse chess, where the game is played backward in time.

2. Discussion of Prior Art

The game of chess has been played for centuries and is used as the quintessential test of intelligence. Several patents have disclosed different variants of this game.

U.S. Pat. No. 7,017,906 discloses a game of Mirror Chess where a mirror is used to see either one's own pieces in mirror and opponents pieces directly or see the opponent's pieces in mirror and one's own pieces directly.

U.S. Pat. No. 7,017,907 discloses a modified chess game where extra pieces are used. These are known as secondary pieces and they are similar to normal pieces except the king is not used in the secondary set of pieces. When the primary piece is destroyed, the secondary piece is moved to the position where the primary piece was positioned. The piece that destroyed the primary piece returns to the square it was in, before advancing.

The common theme in all of these prior disclosures is that the game is played forward in time, with the objective of the game being to destroy the opponent's pieces. In the present invention, the starting point is a pre-identified point in the game of forward chess, where the game is considered to have ended. The game of inverse chess is played backward in time, with the objective of the game being to reconstruct the pre-identified starting point. Thus, this game is played constructively.

SUMMARY OF THE INVENTION

It is an object of this invention to provide a method of playing a game of inverse chess with a pre-identified start layout, a pre-identified end layout and arbitered moves chosen amongst a set of possible moves, played between two opponents on a chessboard. The game of chess is an old one, which has held historical significance. In the regular case (the game which we refer to as forward chess), the game is played forward in time. The opponents start with the pieces (usually 32 of them), lined up on a board (usually having 64 squares), with the objective of the game being to destroy the opponent's pieces. The player that succeeds is termed the winner.

In the present invention, we disclose the game of inverse chess, where the game is played backward in time. In this case, the opponents start with all or a subset of the pieces from a pre-identified start position. This start position in inverse chess is usually an end or middle game from an already played game of forward chess, consequently rendering a small number of pieces on the board when the game begins. The game is played backward in time, with the objective of the game being constructive. The end position in inverse chess is usually the whole board at the start of a forward chess game. Alternatively, the end position in inverse chess could also be a pre-identified end position, which the players decide on by mutual agreement. The players play-chess backwards, attempting to get the pieces of their side to the starting position. For example, if the players agree to reconstruct the whole board at the end of the game, they would play with the objective of bringing back the King, Queen, Two Bishops, Two Knights and Two Rooks in the first row, with eight Pawns being placed in the second row.

The pieces need not follow the same paths, in inverse chess, while proceeding towards a wining position. The process of reconstructing the pre-identified start position is achieved by either of, executing the action opposite that of destroying a piece, in forward chess (this action is referred to as spawning) or a reverse chess move. A piece can be spawned (spawned piece) if another piece vacates a position (vacating piece). In the case of forward chess, the vacating piece would have taken the place of the spawned piece but, this is reversed in inverse chess. The skill of the players is tested by how they move their pieces to the start position, how intelligently they spawn pieces possibly close to their final destinations, etc. Further to spawning, two other moves in inverse chess (inverse check and I-castle) are described, to demonstrate how the moves proceed.

Combinatorially, the state space of this game is bigger than that of chess, since every position in forward chess is a valid position in inverse chess but not vice versa. This game is complicated by this state space. It is not easy for a human being to play even one move, backwards in time. An arbiter is provided to ameliorate this problem. The function of the arbiter is to display all the valid moves possible, at any board position, for any piece. Additionally, simpler versions of this game have been devised. Variations also exist such as the two Knights game where the game is simplified by having a smaller board with only two knights which have to move to a pre-identified winning position, for the game to end.

DETAILED DESCRIPTION OF PREFERRED EMBODIMENTS

We begin by describing the set-up required for the game of inverse chess:

The board is usually the regular chessboard of 64 squares with alternating blacks and whites and the pieces on the board are also the same pieces used in chess. The moves alternate between players with the most important change is the absence of killing of pieces, instead we spawn pieces (i.e. place a piece which was not on the board, appear on the board).

Three moves which will illustrate the game of inverse chess thoroughly, are described below:

Spawning

The game of inverse chess is played backwards in time therefore we have the opposite of destroying a piece, called spawning. A spawn can occur whenever following condition arises:—

1. A non-pawn piece vacates a square, called an optional spawn.

2. A pawn piece moves diagonally, called an enforced spawn.

Figure 1:
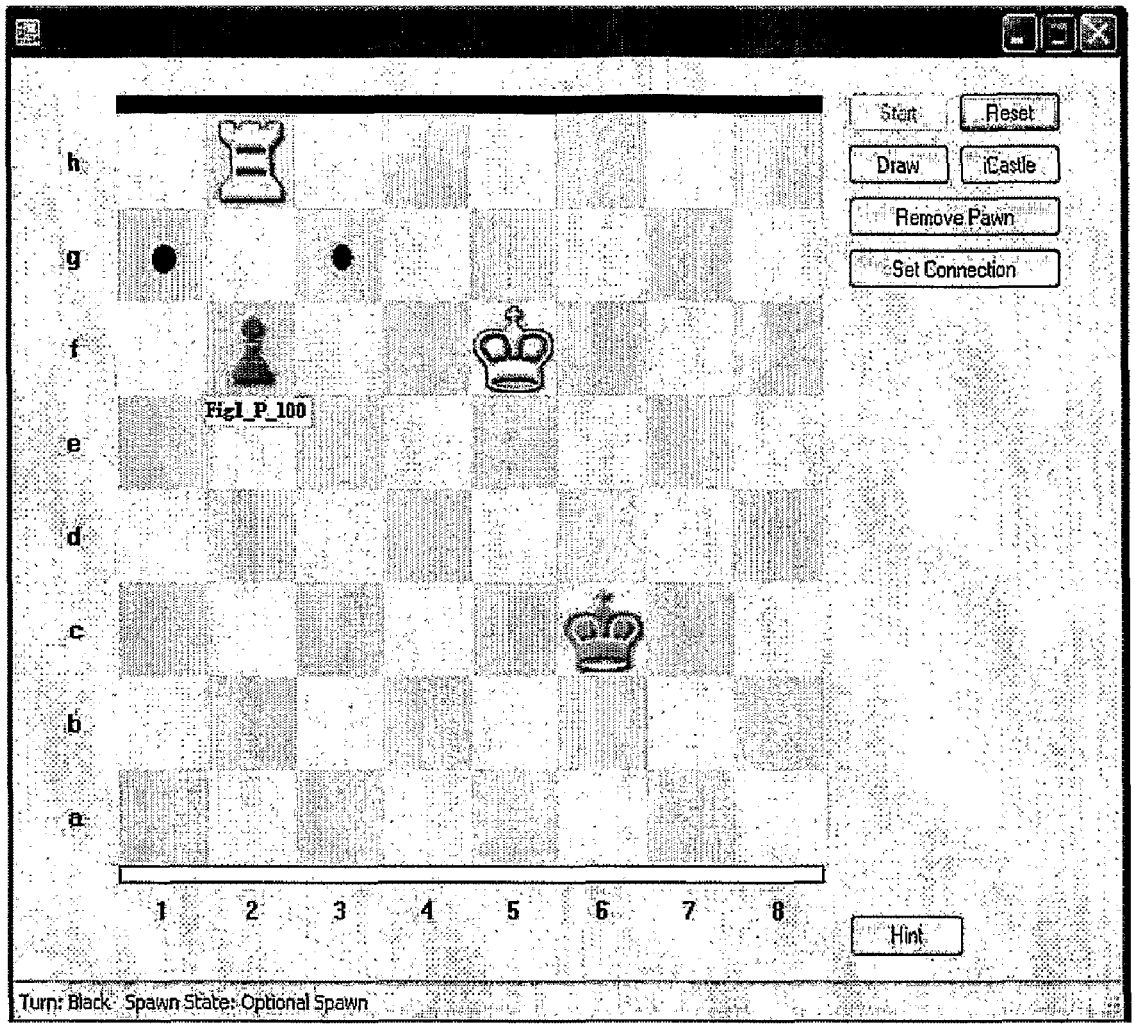
FIG. 1 shows an Enforced Spawn (stage 1)
Figure 2:
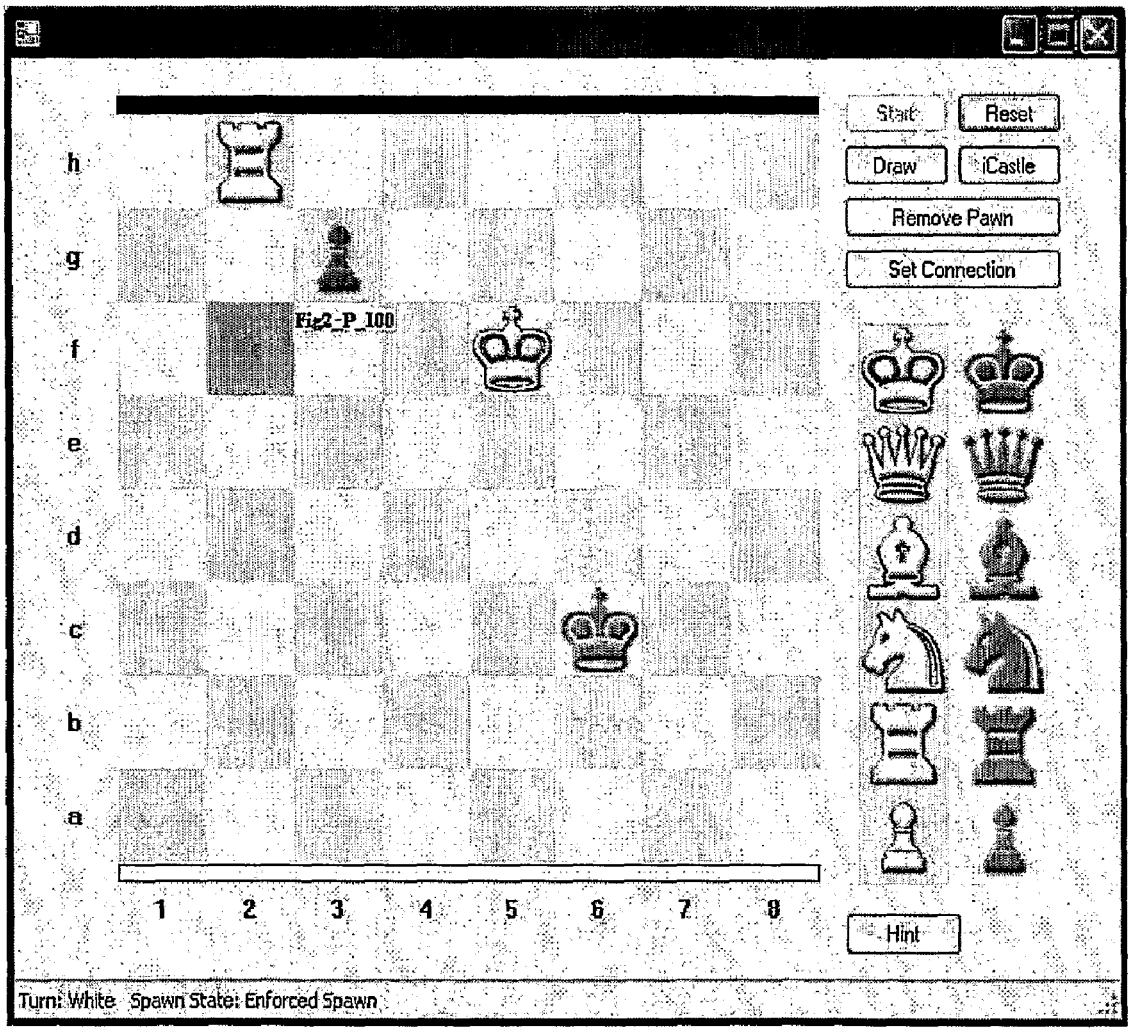
FIG. 2 shows an Enforced Spawn (stage 2)
Figure 3:
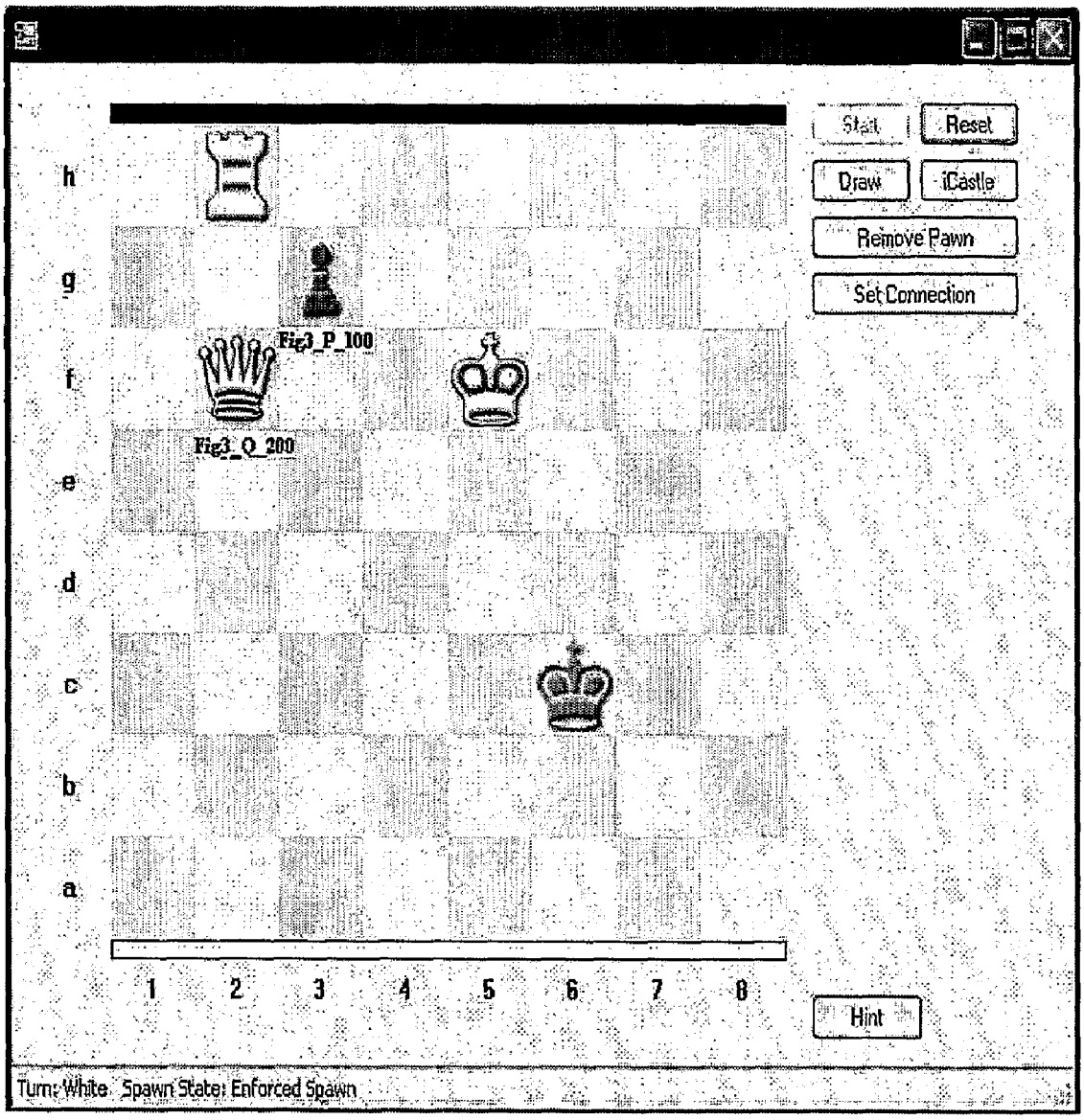
FIG. 3 shows an Enforced Spawn (stage 3)

In inverse chess game a player can give an enforced spawn to the opponent. In that case the opponent is forced to spawn one of his pieces in the next move. In FIG. 1 the piece Fig1_P_100 can give an enforced spawn on opponent by making a move on either of the squares having the black spot. In the following stage in FIG. 2 the piece Fig2_P_100 gives the opponent an enforced spawn by moving diagonally towards right. Now it is mandatory for the opponent to spawn a piece from the place the piece Fig2_P_100 moved. The particular piece being spawned can be chosen by the opponent (among the pieces still available), and is a queen here. As shown in FIG. 3, due to the enforced spawn given by piece Fig3_P_100 the opponent has to spawn a piece Fig3_Q_100 from the place the piece Fig3_P_100 moved.

Figure 4:
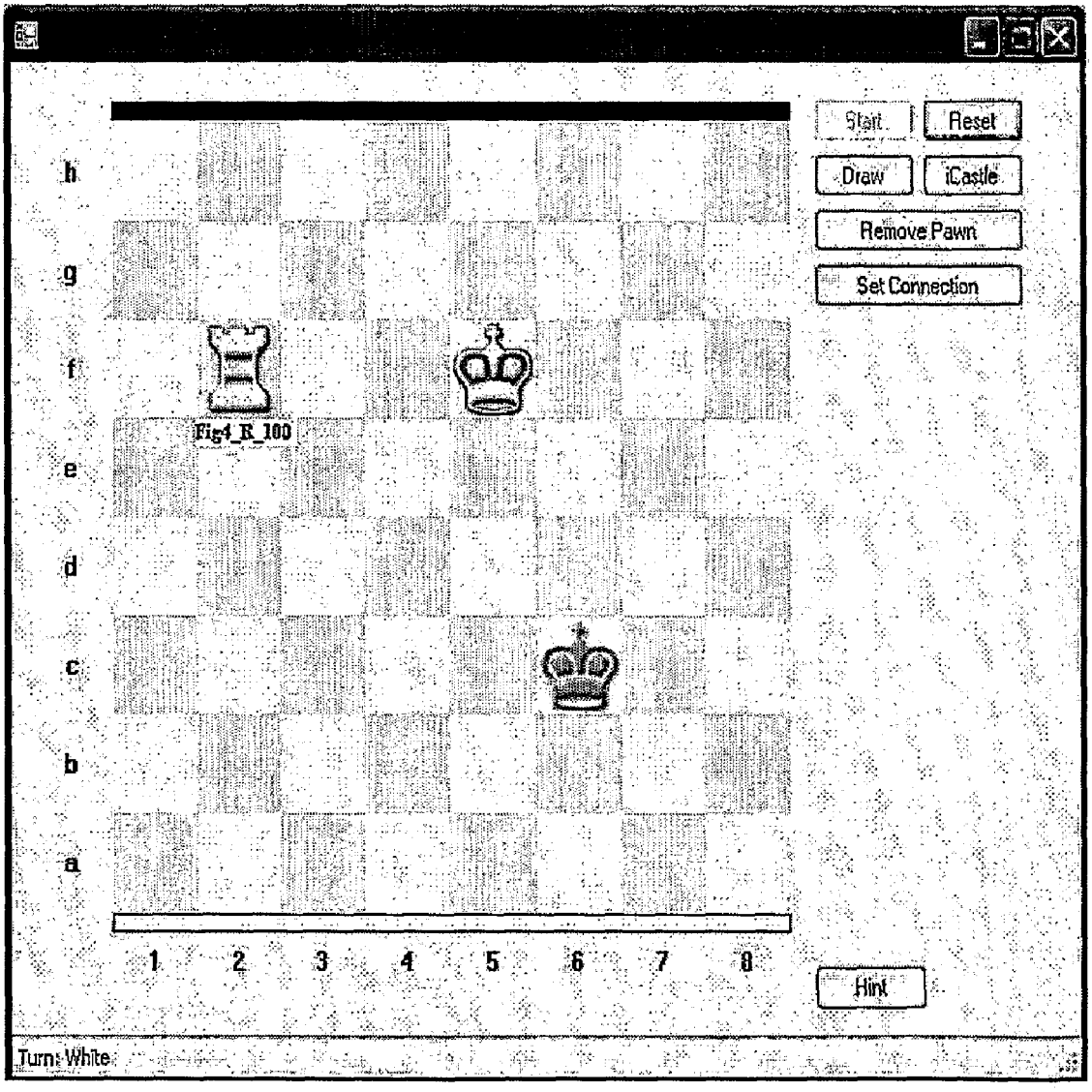
FIG. 4 shows an Optional Spawn (stage 1)
Figure 5:
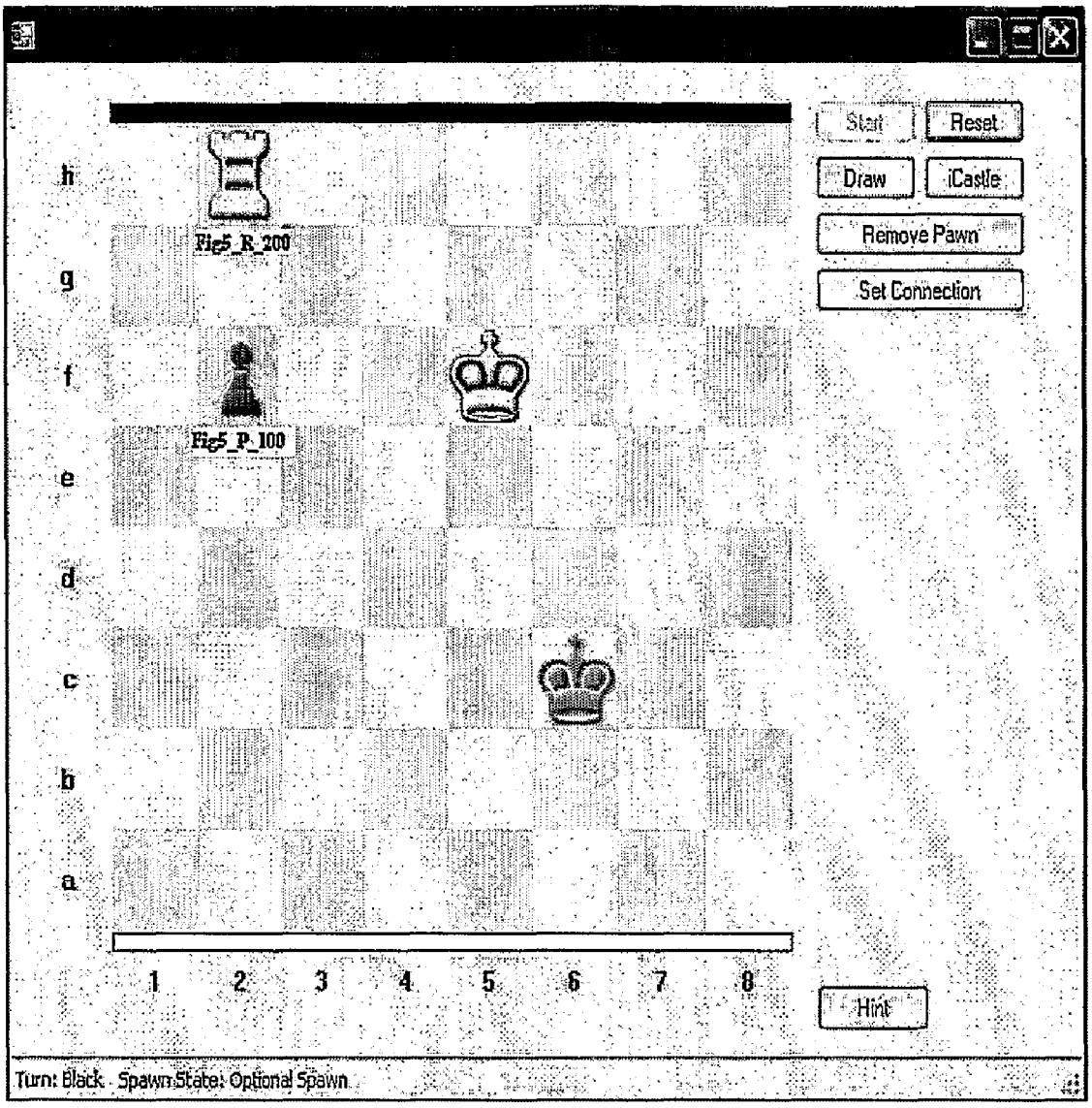
FIG. 5 shows an Optional Spawn (stage 2)

Similarly a player in an inverse chess game has an optional spawn where the player can spawn or avoid spawning depending on the player's strategy. In FIG. 4 the piece Fig4_R_200 moved from its position f2 providing an optional spawn for opponent on that position. The opponent placed its piece Fig5_P_100 on the position f2 from where the piece Fig5_R_200 moved as shown in FIG. 5. However this is not counted as a move in the game and after spawning the opponent can move this or any other piece.

Inverse Check

Figure 6:
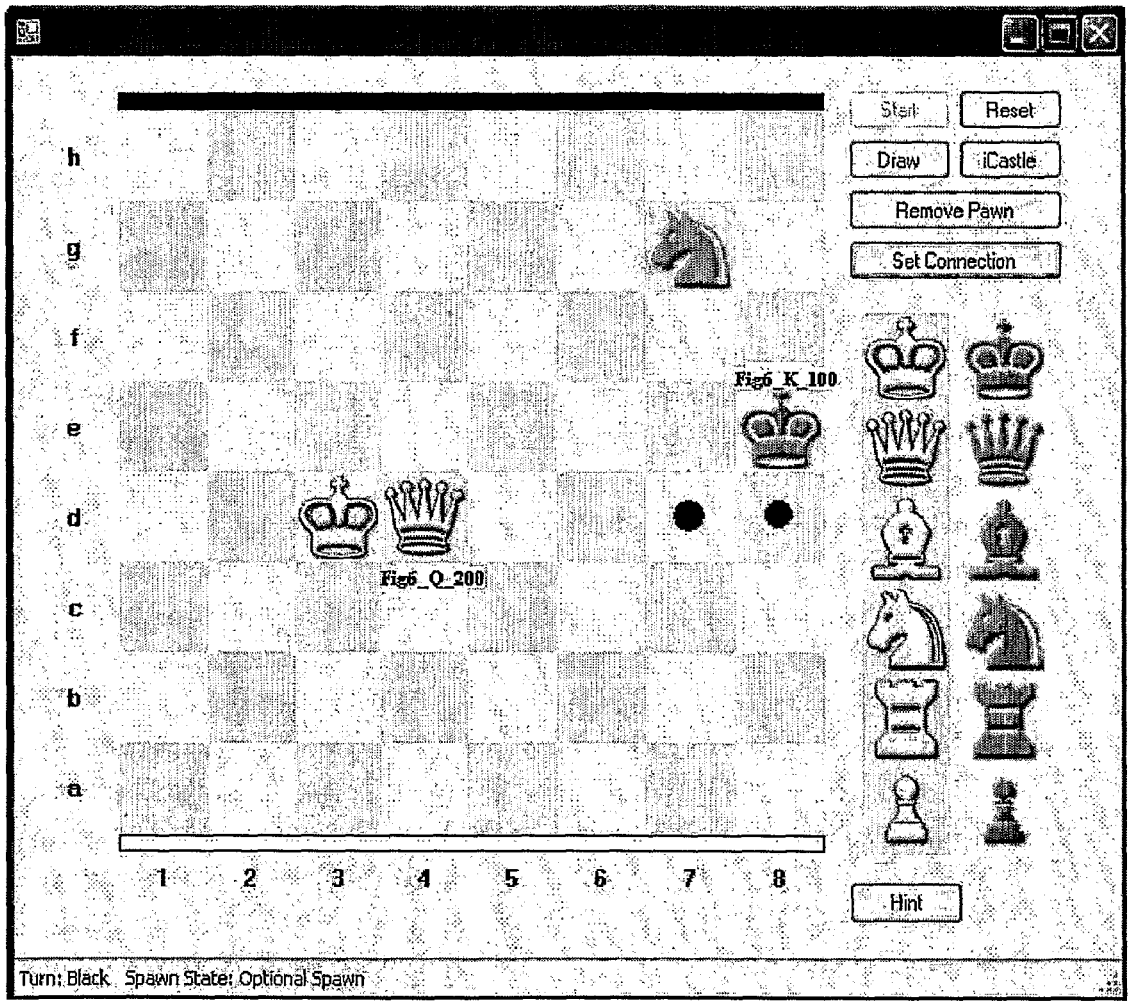
FIG. 6 shows an Inverse Check (stage 1)
Figure 7:
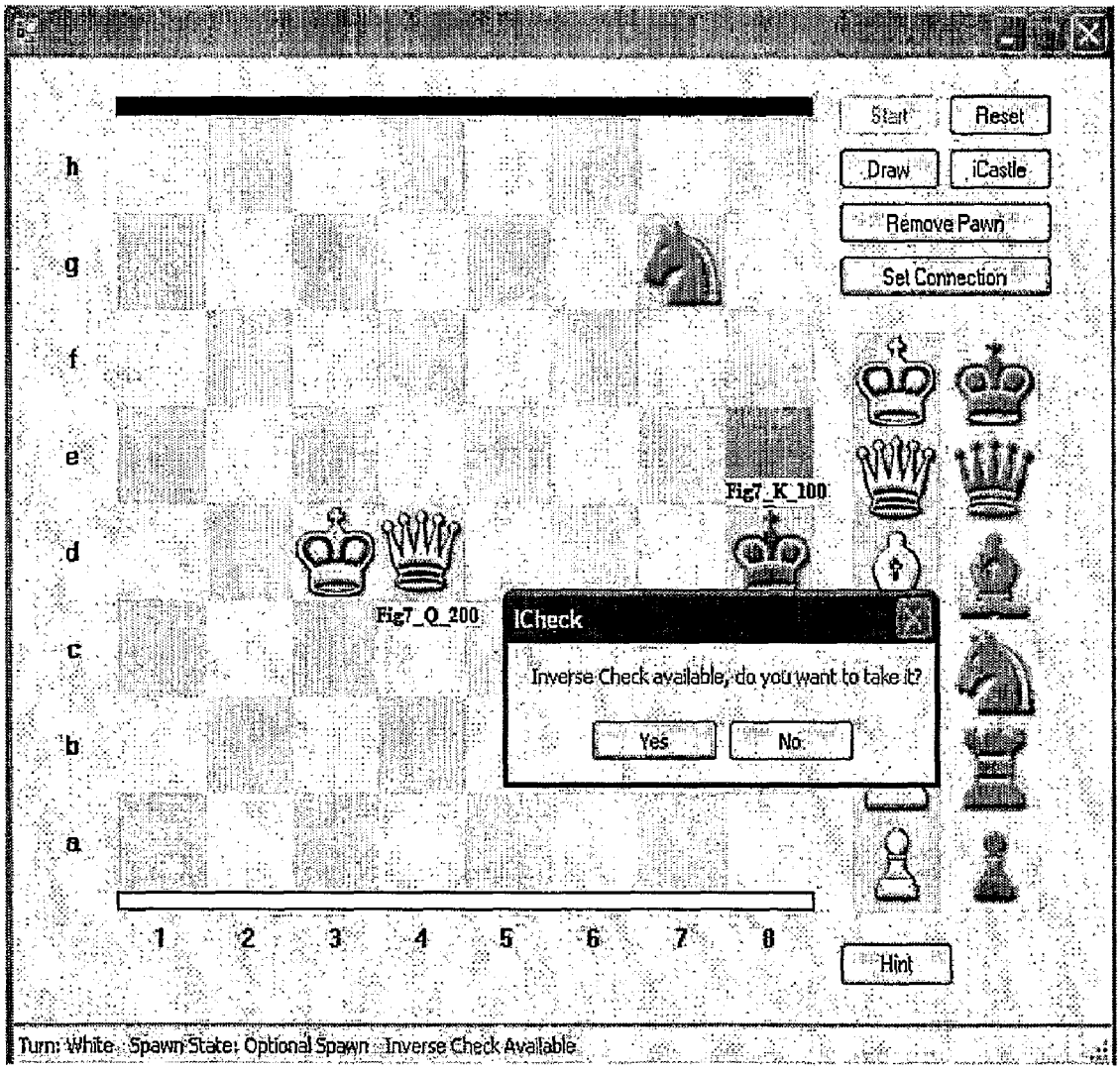
FIG. 7 shows an Inverse Check (stage 2)
Figure 8:
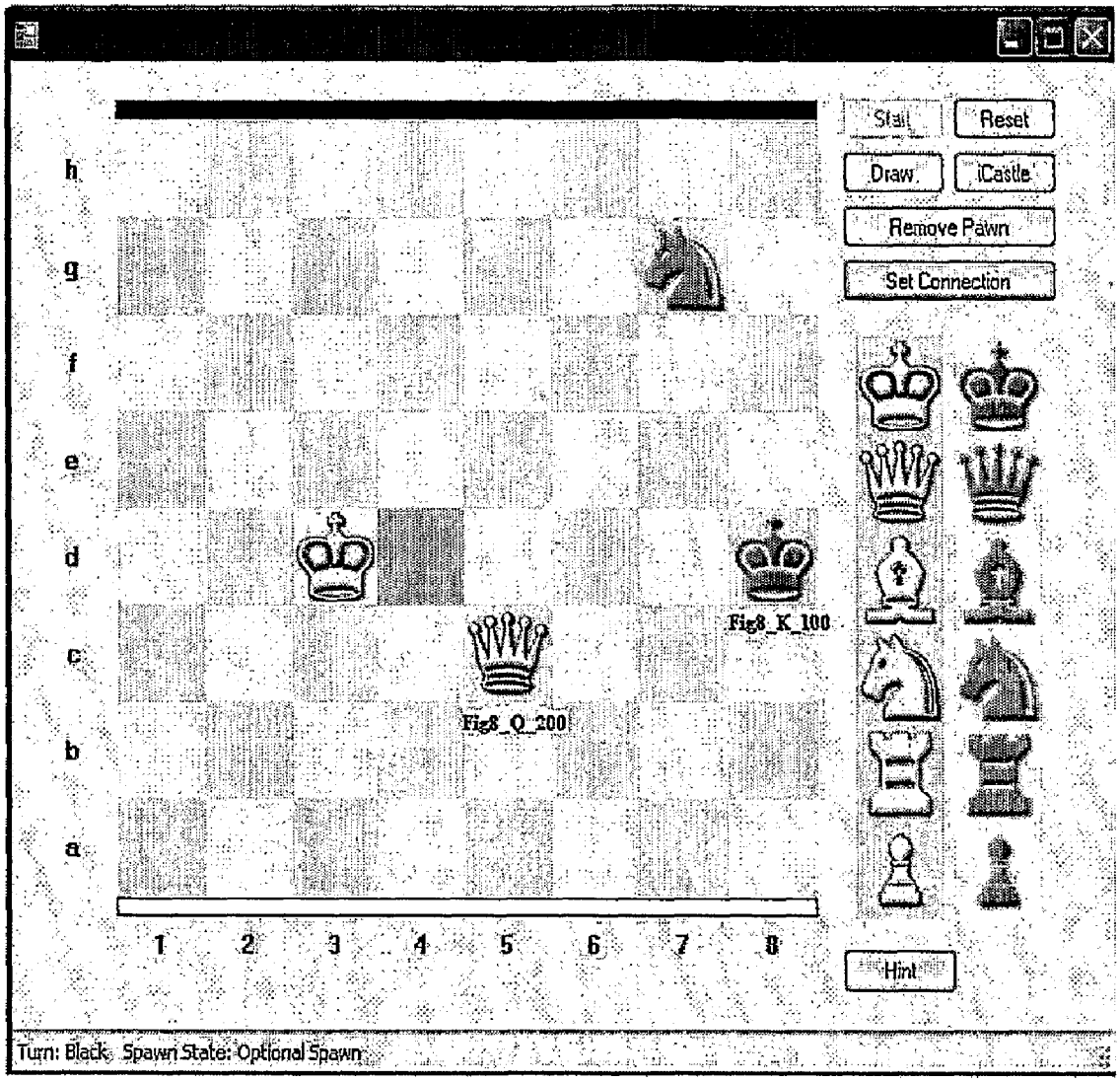
FIG. 8 shows an Inverse Check (stage 3)

Inverse check is the opposite of normal check because here other pieces can be given inverse check by the king and forced to move out from their positions. In FIG. 6, Fig6_K_100 can move to either of the two black spotted positions in order to give the piece Fig6_Q_200 an inverse check. In the next stage, if the inverse check is accepted then the opponent has to forcefully move out its piece Fig7_Q_200 in next move as depicted in FIG. 7. The player can also opt to not use the king for calling and inverse check in which case, the king cannot be moved until the opponent removes the piece. If it is not accepted then the opponent is not bound to do so. But in FIG. 8 the inverse check is accepted therefore the opponent moved its piece Fig8_Q_200 from square d4 to square c5.

I-Castle

Figure 9:
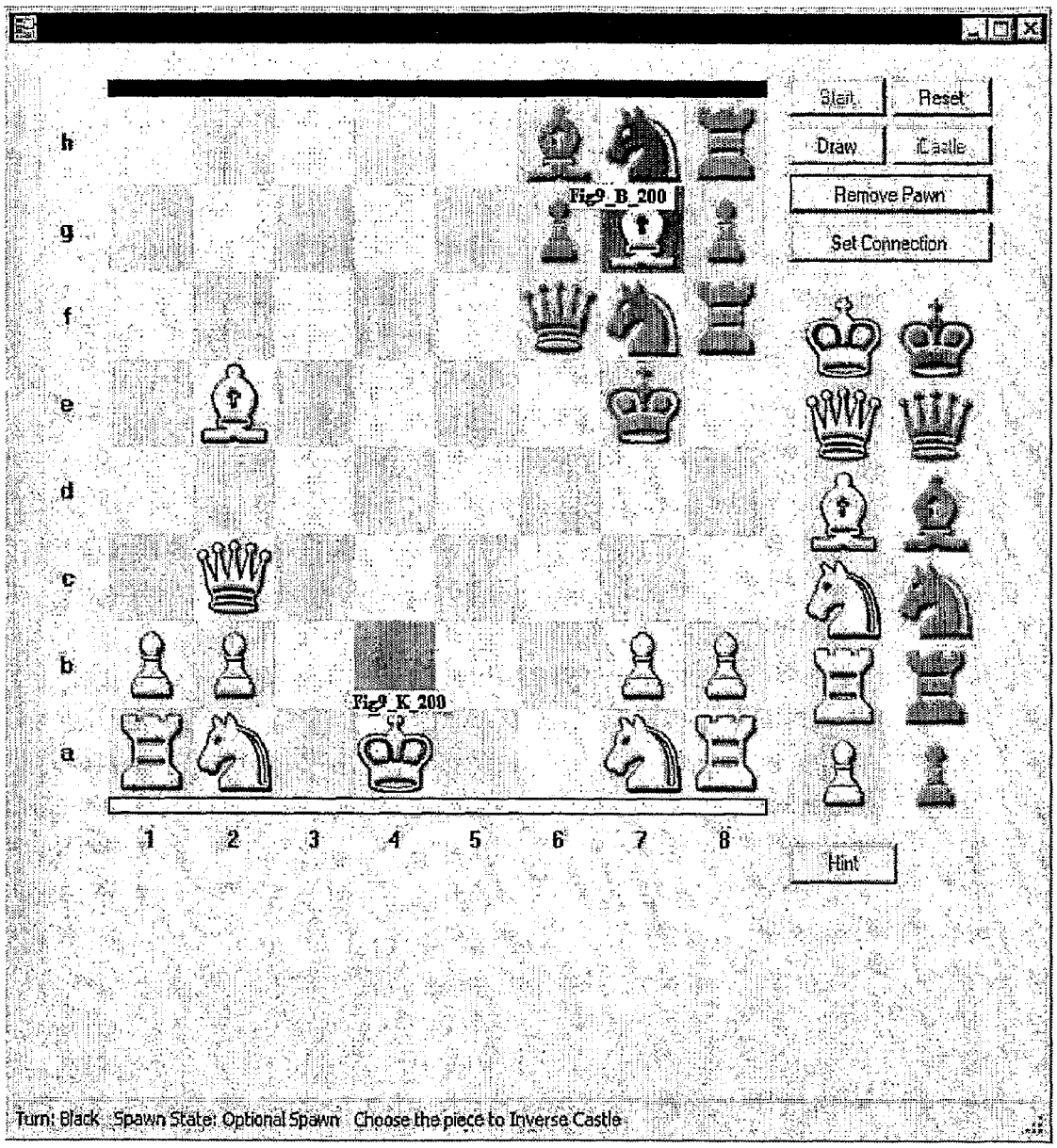
FIG. 9 shows an I-castle (stage 1)
Figure 10:
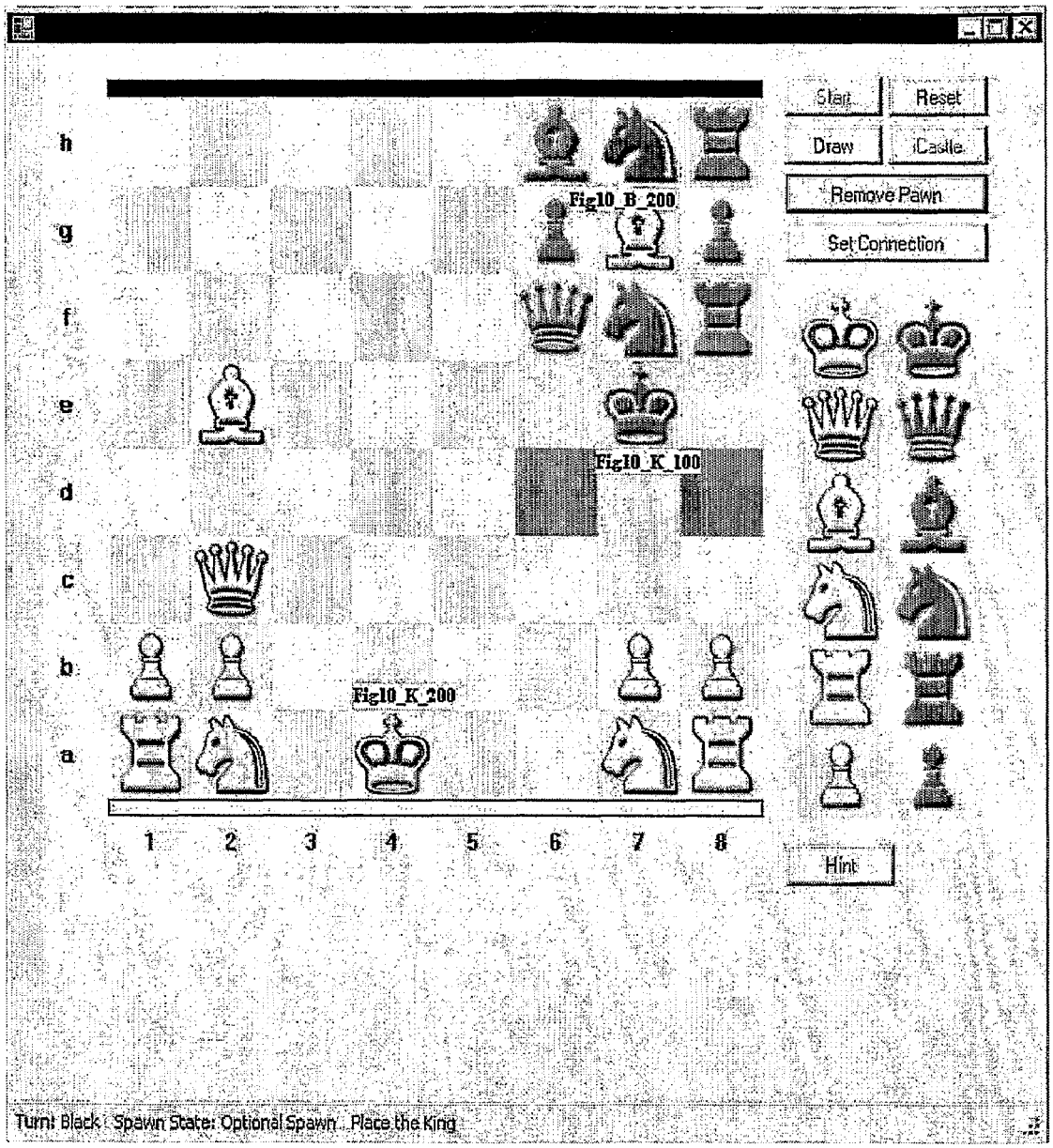
FIG. 10 shows an I-castle (stage 2)
Figure 11:
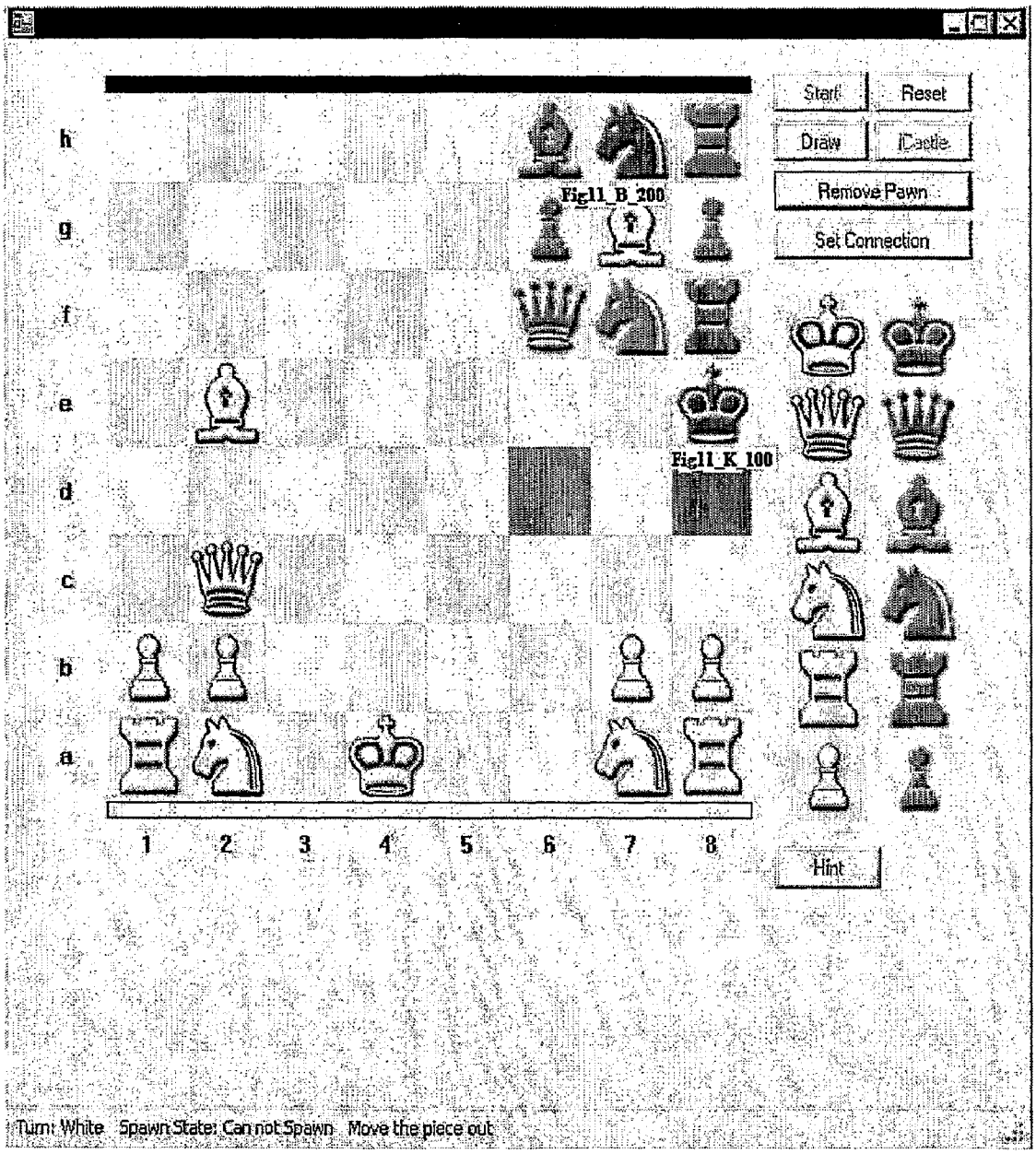
FIG. 11 shows an I-castle (Stage 3)
Figure 12:
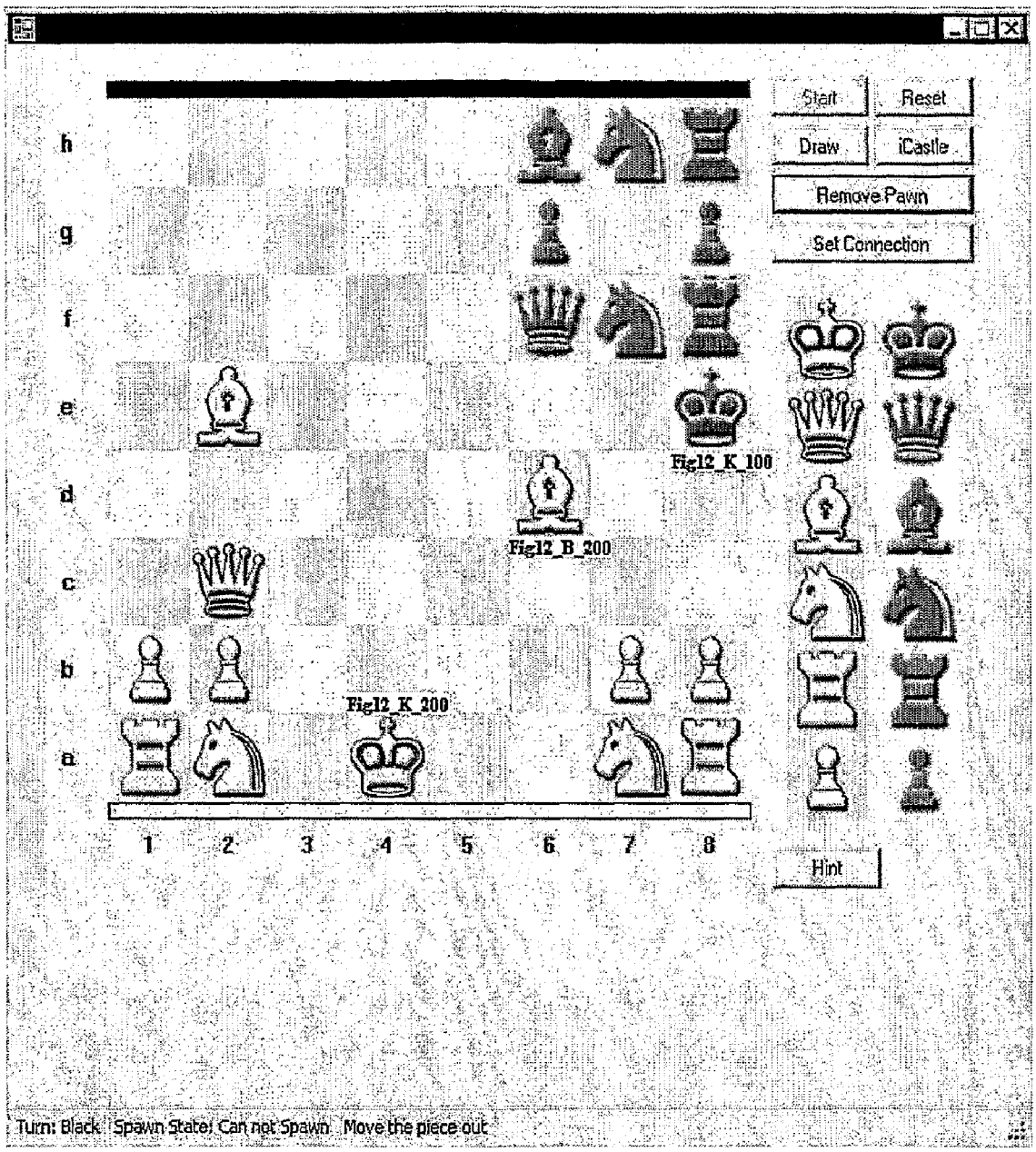
FIG. 12 shows an I-castle (Stage 4)

I-castle is one of the moves of the inverse chess used to reach a winning state. FIG. 9 shows the first stage of one of the example of icastling. Here the i-castle is called on the piece Fig9_B_200. After calling i-castle on the opponent's piece Fig10_B_200 the piece Fig10_K_100 has to make its move on either of the five highlighted positions i.e. e6, e8, d6, d7, d8 as shown in FIG. 10. As the FIG. 11 depicts, the opponent is forced to move out its piece Fig11_B_200 out from that position. In the next step the opponent moved out its piece Fig12_B_200 from position g7 to d6. This move benefits both the sides because pieces for the both the players move towards their base positions.

The rules for the moves made by the pawns are described below:

The pawns move backwards only till we reach the last but one rank (row). Pawns can never enter the last row. When a pawn moves back along a file (column) the opponent can't spawn. When a pawn moves from one file to another diagonally backward the opponent is forced to spawn. When a pawn is in the fourth rank from its base it has an option of moving back two steps along the same file. The bishops can move to any square along its current diagonal. The rooks can move along the rank or the file in which it is currently present. A knight moves one square along the rank or file and then moves to a square diagonally one step away from that square. The knight can move even if there is no clear path for it, i.e. it can jump to the square. A queen can move to any square along its current diagonal or to any square along the same rank or file in which it is present The king can move one step at a time towards any direction i.e., to any adjacent square. The king when it comes in the way of any opponent's piece or if it is diagonally in front of a pawn has the option of calling an inverse check. The piece which caused this inverse check has to move to a place from which there can be no inverse check called by the king from the current position. The king can opt for not calling an inverse check, in which case the king cannot move out of that position until the opponent removes the piece. In the above case the king has an option of moving into any other place from which it could have given an inverse check but cannot give the inverse check. The king cannot call an inverse check on an opponent's pawn, which is already in its base rank. The king and the rook together can perform inverse castling.

In general, an invalid board position is a position, which cannot occur, in a normal game of chess. No move should be made which may in future be able to lead to an unavoidable invalid board position. Spawning can be done on the square from which any piece moves except for a pawn, in which case spawning cannot be done if it moves along a file or else the spawn will be compulsory. A spawn is not a move in itself, as a part of a spawn the player can also move a piece including the piece just spawned.

The Game of Two Knights

A game of two knights is disclosed which is to be played between a computer player and a human player. This game will act as a small tutorial for the players before going through the game of inverse chess.

In the usual case, the two knights game is played on a chessboard having 64 square. One black and one white knight will be placed randomly at any position on the board with their separate winning positions chosen randomly by the computer. Now, the player who first moves the knight to its winning position will win the game.

Figure 13:
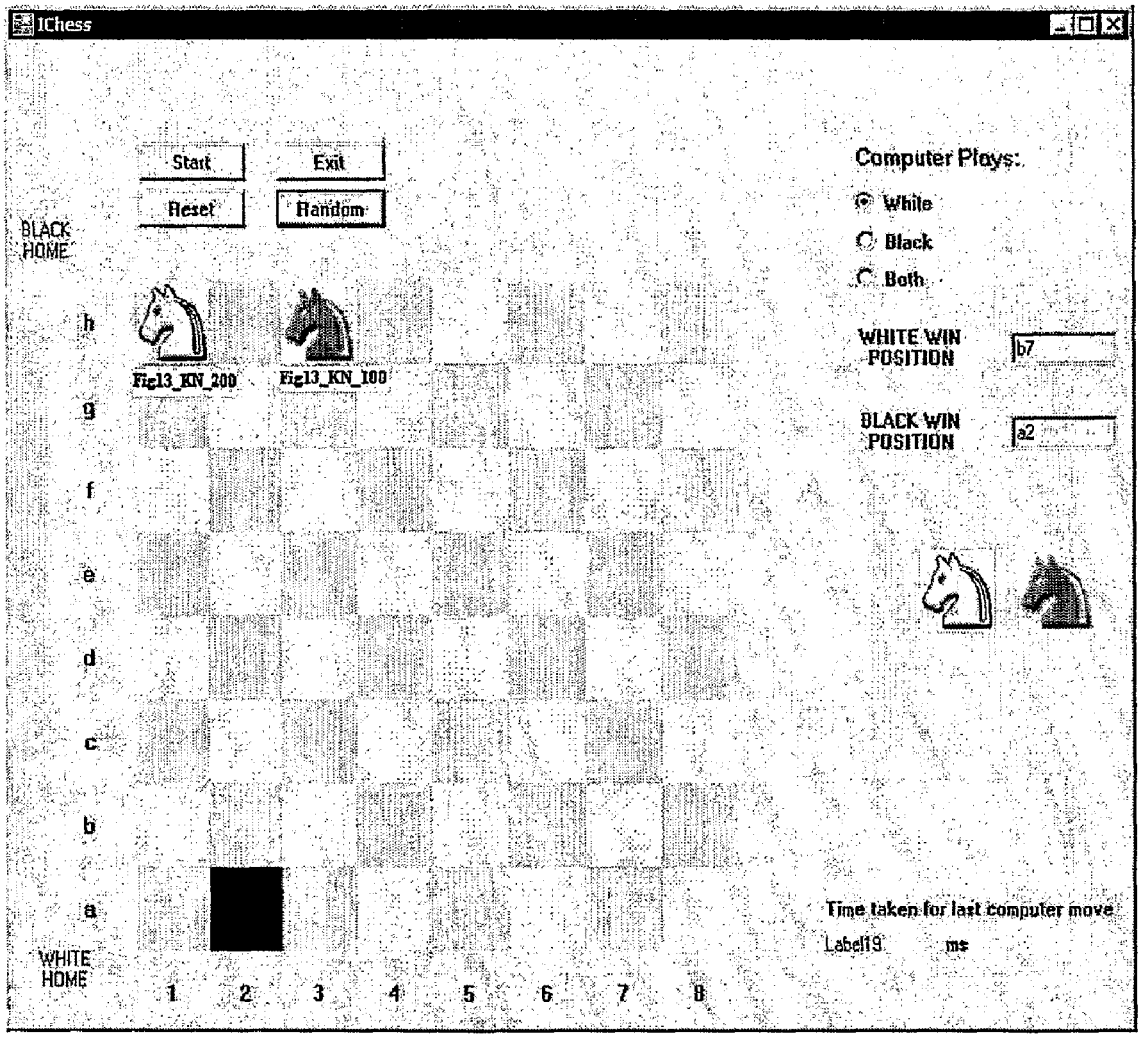
FIG. 13 shows a Two Knights Game (stage 1)
Figure 14:
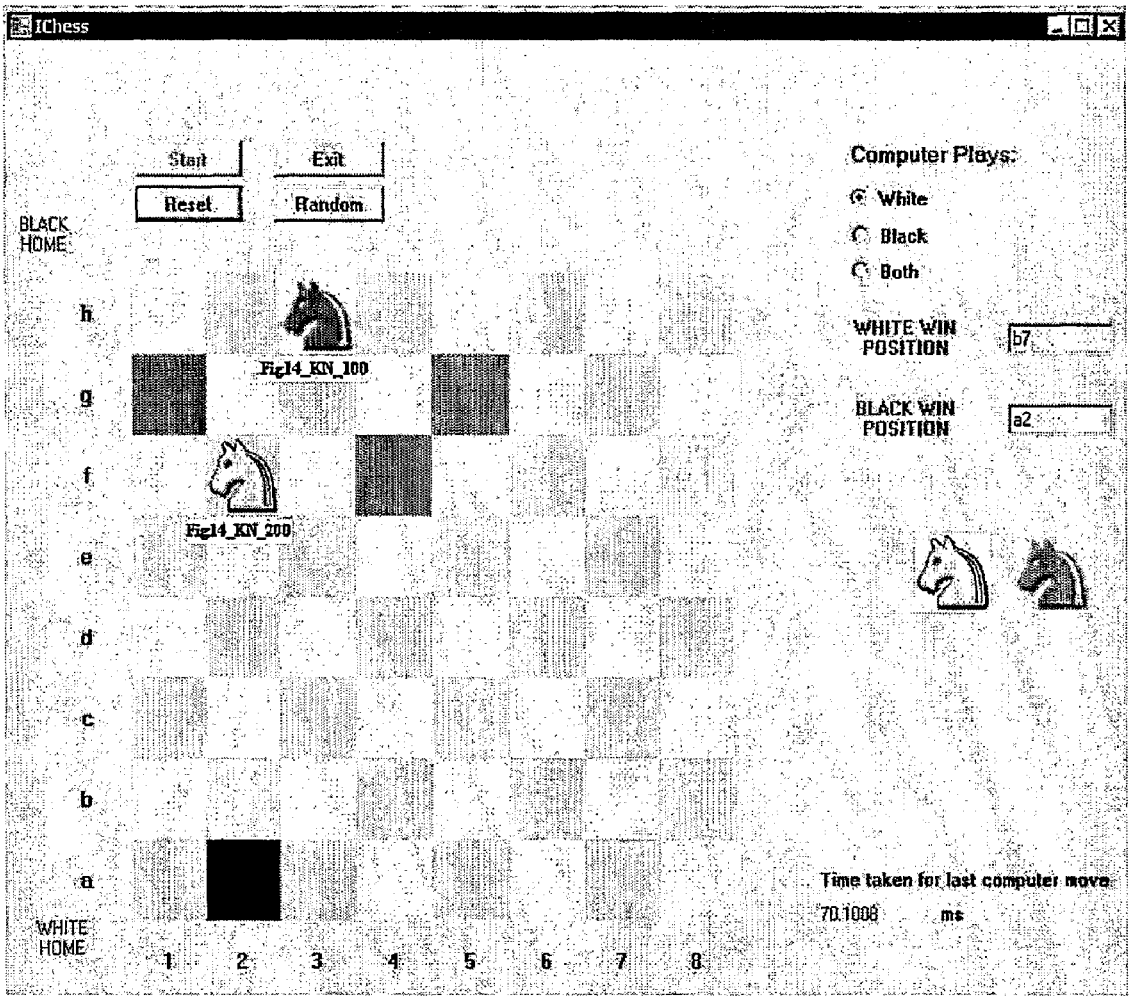
FIG. 14 shows a Two Knights Game (stage 2)
Figure 15:
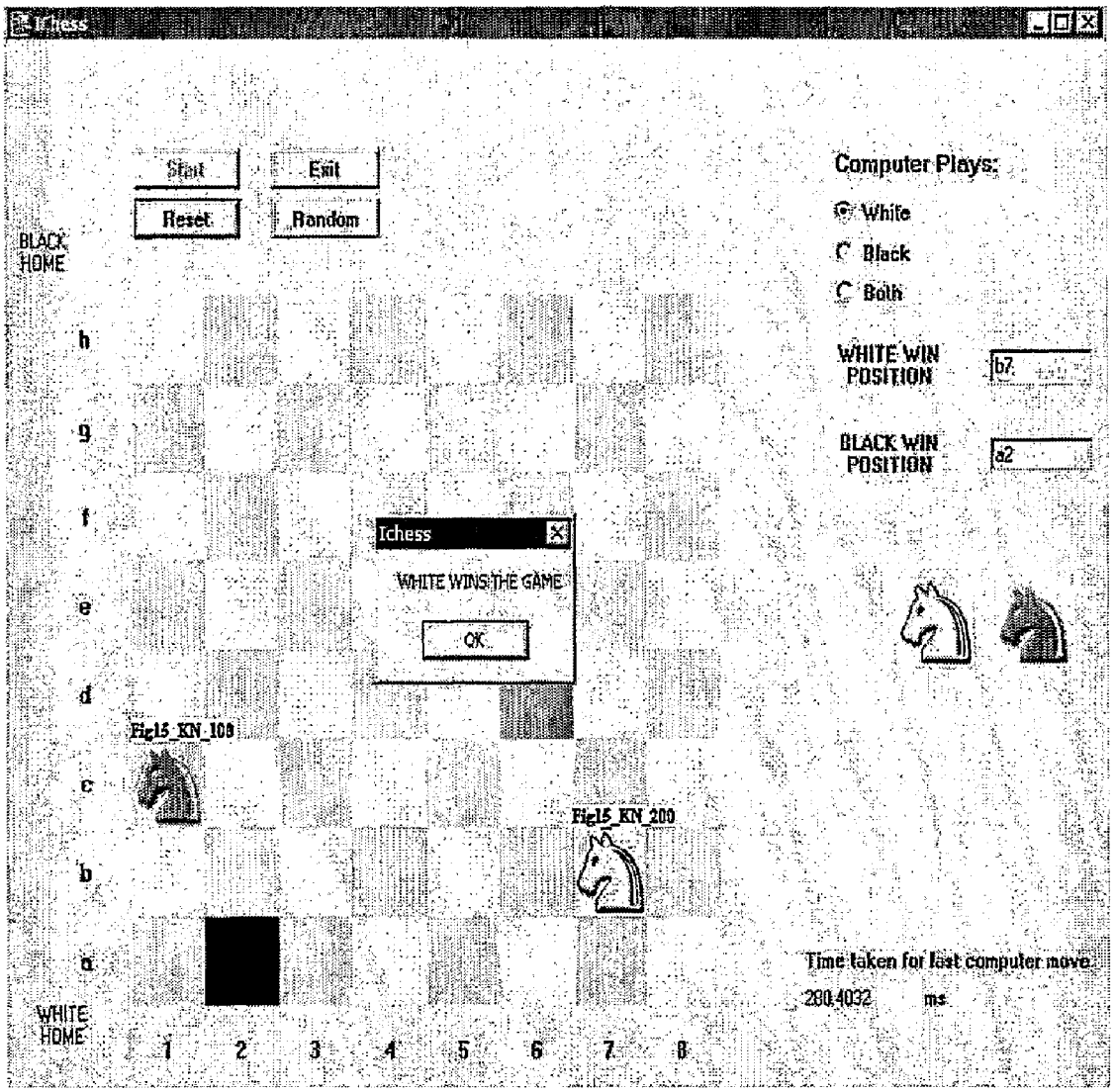
FIG. 15 shows a Two Knights Game (stage 3)

FIG. 13 shows one of the starting positions for this game. Here the white piece that is Fig13_KN_200 is played by computer player and Fig13_KN_100 is played by the human player. The piece which reaches it winning position first i.e. b7 for Fig13_KN_100 and a2 for Fig13_KN_100 wins the game. In the next step as shown in FIG. 14, after the piece Fig14_KN_200 made its move the piece Fig14_KN_100 can make its move on either of the highlighted positions. The piece Fig15_KN_200 reaches it winning position first and therefore wins the game as shown in FIG. 15.

The Arbiter and the Inverse Chess Player

Figure 16:
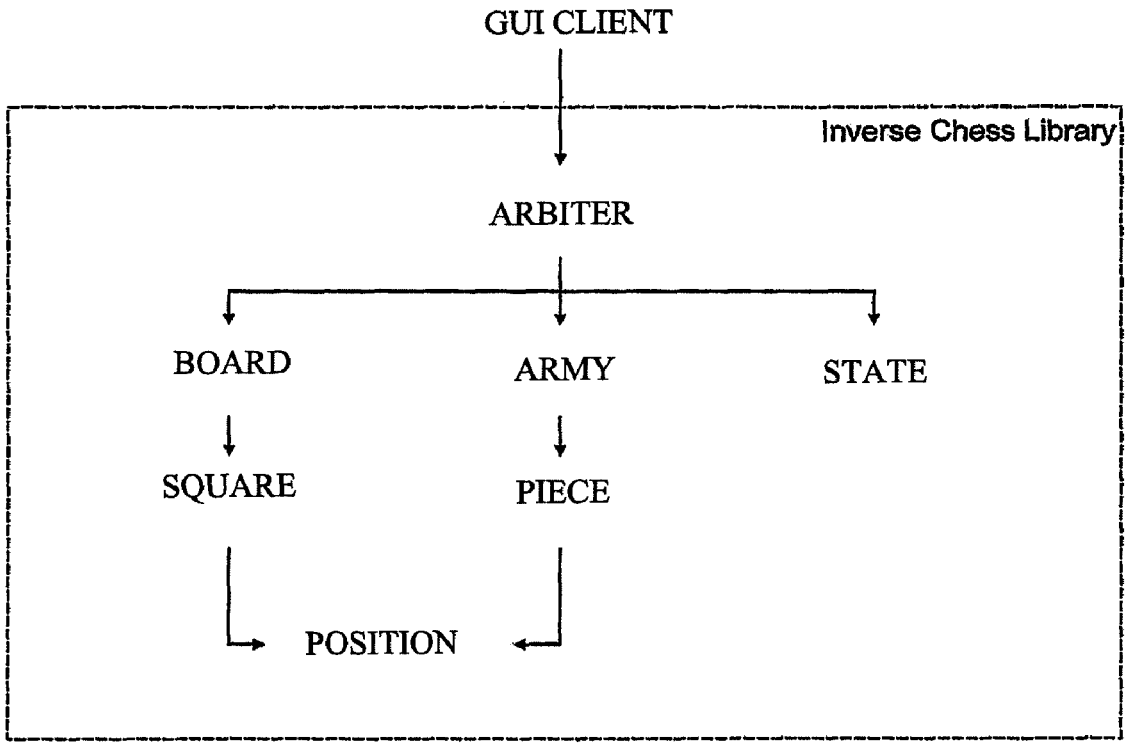
FIG. 16 shows an arbiter that is an interface between all the other components of the game.

As discussed earlier, an Arbiter has been created to help play this game. It shows valid moves at any position. In the preferred embodiment, the game of inverse chess is implemented on a computer where the arbiter is the interface between the GUI Fig16_G_1 and all other components of the game. As shown in the FIG. 16, the arbiter Fig16_A_1 has objects of the board Fig16_B_1, the armies Fig16_Ar_1 and the states Fig16_S_1 of the game. Here, the pieces Fig16_P_1 move between squares Fig16_Sq_1 to get to a certain position Fig16_Pos_1.

Aboard contains a set of 64 squares with each square having a distinct position. Similarly, an army has 16 pieces and each piece has a distinct position on board or it is off board. The arbiter's most complex part is its rule base. A rule base is a collection of rules present inside the arbiter. The game of inverse chess is too complex to play without this rule base. The rule base keeps checking whether the game is going in a legal fashion. The rules in the rule base are classified into three sections, i) Pre-move rules; ii) Current-move rules; iii) Post-move rules.

Pre-move rules: These rules are enforced/checked before the move is made. These are checks which answer questions akin to 'can apiece move from a particular place when there is an inverse check?', 'Is the game out of turn?', and so on.

Current-move rules: These are rules which are quite similar to the moves in chess. Additionally other state changes are also taken care of during the move. For example, 'Can a pawn move from square 'a' to square 'b' and if it can then what is the current spawn state?' Here global invalidity (discussed later) should also be taken care of.

Post-move rules: These are generally invalidity checks. The questions that are answered here are whether the game is entering a state which when inverted in time could not have occurred in the game of chess. These are a set of computation intensive algorithms, which can actually be called as the backbone of the arbiter.

Global Invalidity Sometimes Inverse Chess reaches a state where the move by itself is valid but it takes the board into an illegal position. For example, let us assume that the king moves into a square, which is an inverse check Enforced Spawn rule: A pawn may move to an unoccupied square, which is diagonally at the back of it on an adjacent file, thereby giving an enforced spawn to the opponent. This move is allowed only when the opponent is able to spawn a piece there. It is worth noting that the pawn is the only piece, which can give an enforced spawn.

Inverse Check rule: When a king comes in the way of an opponent's piece or if it is diagonally in front of a pawn, the player has the option of calling an inverse check provided that the piece is able to move out or put a piece which blocks the path. The player cannot call an inverse check using his or her king when there are two or more pieces to be put out of the site in one move. The piece, which caused this inverse check, has to move to a place from which there can be no inverse check called by virtue of the king occupying the current position. The player can opt to not call an inverse check, using his or her king, in which case the king cannot move out of the position until the opponent removes the piece. The player cannot use his or her king to call an inverse check on an opponent's pawn, which is already in the base rank.

I-castle rule: A player can use his or her king to give inverse castle to an opponent's piece by forcing it towards in its own side. To give i-castle, the player's king should move from the position in the file, which is say two away from the piece, and the rank should be same or adjacent.

On receiving i-castle, the piece has an option of moving five places adjacent to the place where the king earlier was. The i-castle cannot be given if the piece has no place to go.

Spawning rule: The process of putting a new piece on the board is called spawning. Spawning can be done on the square from which any piece moves except for a pawn, in which case the spawning can't be done if it moves along a file or else the spawn is compulsory. A spawn is not a move in itself, as a part of a spawn the player can also move a piece including the piece just spawned.

Inverse Chess Player and Helper

In the preferred embodiment, an inverse chess player and a helper for the game of inverse chess exist, enabling a computer player and a human player game. The computer can play against a human player as well as learn from the moves made by the human player. Further, an inverse chess helper assists the human player in making his moves by knowing the possible moves available at an instant.

Some Variants of the Diverse Chess Game:

1. Inverse Chess Algorithms can be quite complex for a full 8×8 board, with the entire set of pieces and board position to be reconstructed. Hence we can conceive of a variant played on a smaller board and/or with possibly fewer pieces, etc. Exemplarily, we can have a game on a 6×6 board, without rooks, and the two pawns in front of them.
2. We can conceive of a variant with starting with only two or a few pieces—say two Knights, which have to go to their respective home locations (or other pre-identified locations). The player whose piece or pieces reaches the destination first is the winner. Each player tries to moves pieces such that they move towards their destinations, as well as prevent the other player's pieces from reaching their respective destinations. This variant is described in detail above.
3. Another simplified version does not require the generation of a complete initial position of the board.
   a. Exemplarily, the players can possibly agree on an end-game, and a position which each will attempt to create using backward moves. These positions need not be identical in general. For example, the players can agree on an end-game with a King and a Rook each. White can try to create a possibly initial position with a King, a Rook, and Two Bishops. Black may attempt to create Black's complete initial position (it is possible that Black is a much better player, and this is a way of imposing a handicap).
4. Another version requires the pieces to visit squares, and occupy territory. In an exemplary instantiation, a square visited by white cannot be visited by Black, and vice versa. Whoever visits more squares before at least one party has no further moves, is the winner. We can have variants in which a square once visited, cannot be visited again, even by the same side, or one in which the same or opposite side can visit them again.
   a. An example of this variant is the two (or more) knights problem, where the objective for each side (which may have one or more knights) is to visit as many squares as possible, without revisiting a square already visited (by either side). The side that visits more squares before at least one side runs out of moves is the winner. This is a generalization of the famous Knights tour problem, to two (or more knights).
   b. Another variant is the above problem with general pieces instead of only knights
5. Another variant keeps a number of pieces (White and/or Black) on the board, but allows movement of only a subset of pieces (backwards or forwards). The objective is to get as far as possible towards the board beginning (or other agreed to position) by moving only these pieces
   a. A variant would be moving forwards towards a win (or other agreed to position) by moving only these pieces.
   b. Another variant is to occupy as much territory as possible, using the subset of pieces which can move. Pieces which do not move act as obstacles. An exemplary instantiation would be doing a Knight's tour of a board, with squares, which cannot be visited—obstacles. This game can be played by only one side, or by two sides, with two knights and obstacles for them.
6. A variant would be chess or chess-like moves being used to play forwards, backwards, or occupy territory, on a board which need not be square—it can be rectangular, or a torus, or a general 9-regular bordered graph (i.e. a graph each of whose vertices is adjacent to 9 others, except those at the borders).

The invention claimed is:

1. A non-transitory computer-readable storage medium including instructions to enable a computer to execute a computer-implemented method of playing a game of inverse chess, the game of inverse chess having a pre-identified start layout, a pre-identified end layout and moves chosen amongst a set of possible moves, the game of inverse chess played between a player and an opponent on a chessboard comprised of ranks (rows) and files (columns), the game of inverse chess having an objective of reconstructing the pre-identified start layout from the pre-identified end layout, said pre-identified start layout and said pre-identified end layout each specifying positions occupied by various pieces used in the game, the method comprising the steps of:

a. placing chess pieces on the chessboard for the player and the opponent according to the pre-identified start layout;

b. playing said game of inverse chess by making a sequence of allowable moves, with each of said allowable moves satisfying rules (a), (b), (c), (d), (e) and (f), wherein said rules (a), (b), (c), (d), (e) and (f) are defined as follows:

rule (a) that includes a move in forward chess, rule (b) that includes a spawn move that includes the player placing a piece on the chessboard in a square vacated by the opponent, and the player making a move consistent with rules (a) through (e), the added piece being one of his pieces not already present on the chessboard, wherein the spawn move comprises one of:

a. an optional spawn move that includes adding the piece to the chessboard when a non-pawn piece of the opponent vacates the square in a previous move; and b. an enforced spawn move that includes adding the piece to the chessboard when a pawn piece of the opponent moves diagonally in the previous move;

rule (c) that includes an inverse check move that is defined as follows:

when a king piece of the player is placed in a position near an opponent's piece so as to cause check or when the king piece of the player is moved to a position diagonally in front of a pawn, the player has an option of calling an inverse check to force the opponent's piece to move or to force the opponent to put a piece on the chessboard to block the check, provided that a) the opponent's piece has the ability to move to avoid the check or b) the opponent is able to put the piece on the chessboard to block the check, wherein the king piece of the player cannot be used to call an inverse check when there are two or more pieces of the opponent that are incapable of moving to a place from which there can be no inverse check called, wherein the player can opt to not call the inverse check, in which case the king piece of the player cannot move out of the position near the opponent's piece until the opponent's piece is removed, wherein the player is prohibited from calling the inverse check on an opponent's pawn which is already in a base rank, rule (d) that includes an inverse castle move where the player forces an opponent's piece to move towards its own side, wherein, in order to force the inverse castle move, the player's king must be moved from a position which is two away from the opponent's piece and the ranks of the player's king and the opponent's piece are the same or adjacent, wherein, upon being forced to make the inverse castle move, the opponent's piece has an option of moving five places adjacent to the player's king's position that is two away from the opponent's piece, and wherein the player cannot force the inverse castle move on the opponent's piece if the opponent's piece has no place to go;

rule (e) that includes a remove pawn move where the player can remove one of his pawns from the chessboard; and rule (f) that includes any move that satisfies rules (c), or (d) or (e), and does not satisfy rules (a) or (b); and c. Reaching a winning position when one of the player and the opponent has all their pieces in the pre-identified end layout.

2. The non-transitory computer-readable storage medium according to claim 1, which is able to specify:

a. the pre-identified start layout comprises one an end layout or a middle layer in a game of forward chess, said pre-identified start layout and said pre-identified end layout being similar or different for each of the player and the opponent; and b. the pre-identified end layout comprises one an end layout or a middle layer in a game of forward chess or regular chess, said layout and said pre-identified end layout being similar or different for each of the player and the opponent.

* * * * *